United States Patent [19]

Asano et al.

[11] 4,131,091

[45] Dec. 26, 1978

[54] VARIABLE GAIN CLOSED-LOOP CONTROL APPARATUS FOR INTERNAL COMBUSTION ENGINES

[75] Inventors: Masaharu Asano; Nobuzi Manaka, both of Yokosuka, Japan

[73] Assignee: Nissan Motor Company, Ltd., Japan

[21] Appl. No.: 734,752

[22] Filed: Oct. 22, 1976

[30] Foreign Application Priority Data

Oct. 27, 1975 [JP] Japan ..... 50/128348
Dec. 25, 1975 [JP] Japan ..... 50/154100

[51] Int. Cl.[2] ..... F02B 3/00
[52] U.S. Cl. ..... 123/32 EH
[58] Field of Search ..... 123/32 EH, 32 EE, 32 EL, 123/119 EC; 60/276, 285

[56] References Cited

U.S. PATENT DOCUMENTS 3,831,564 8/1974 Schmidt et al. ..... 123/32 EE

*Primary Examiner*—Samuel Feinberg

[57] ABSTRACT

In a closed-loop mixture control system for internal combustion engines, the concentration of an exhaust composition contained in the emissions from the engine is compared with a predetermined value in a comparator to determine whether the fuel quantity is to be corrected in a direction to increase it or decrease it. The rate of change of the correction is controlled in response to a sensed acceleration or deceleration of the engine for a small duration of time to compensate for the error arising from the transport delay time of the engine at the instant of the acceleration or deceleration.

13 Claims, 3 Drawing Figures

VARIABLE GAIN CLOSED-LOOP CONTROL APPARATUS FOR INTERNAL COMBUSTION ENGINES

The present invention relates to mixture control apparatus for internal combustion engines, and in particular to a closed-loop mixture control apparatus which ensures against control oscillation under transient engine operating conditions.

In a closed-loop mixture control apparatus, an exhaust composition sensor is utilized to detect the concentration of a particular composition (CO, $CO_2$, HC, $NO_x$, or $O_2$, etc) in the emissions from the engine. The signal from the sensor is compared with a reference value and fed into an integral and/or proportional controller to modulate the signal amplitude in accordance with a predetermined control algorithm to minimize undesirable consequences due to the inherent delay time present in the system. The delay time is related to the time for the fuel and air mixture to reach the cylinders, be inducted, combusted, exhausted, and then travel through the exhaust system to the sensor. If corrective measures are not taken, the controllers will keep influencing the air-fuel ratio after the reference value has been reached, this resulting in a control oscillation. This control oscillation will increase in amplitude if the system response time is considerable, thus adversely affecting the drivability of the vehicle.

To overcome this problem, proposals have been made in which the control gain of the proportional and/or integral controllers is varied in response to the time of occurrence of disturbance. However, for a certain length of time after variation of the control gain, the signal from the exhaust composition sensor will be at the same value as previously due to the transport delay time of the engine. Specifically, when the engine is decelerated the control gain is reduced in response thereto and the exhaust sensor will provide a signal which represents the previous state of air-fuel ratio which may be richer during the initial period of the deceleration due to the transport delay time of the engine. Conversely, when the engine is accelerated the control gain is increased in response thereto and the exhaust sensor will provide a signal which may be leaner during the initial period of the acceleration.

It is an object of the present invention to provide a mixture control apparatus in which the control algorithm is to effect a higher control gain for a predetermined duration in response to acceleration and to effect a lower control gain a predetermined period after the instant of deceleration to compensate for the delayed signals from the exhaust composition sensor.

In accordance with the present invention, there is provided a mixture control apparatus for an internal combustion engine having means for sensing an exhaust composition of the emissions from the engine, air-fuel mixing and proportioning device for the engine, and a comparator for generating an output when the sensed composition reaches a predetermined value, the apparatus comprising means for sensing acceleration and deceleration of the engine, and an integral controller operable to provide integration of the output from the comparator at a higher rate of integration for a first predetermined period after the sensing of the engine acceleration than during the time prior to the sensing of the engine acceleration and at a lower rate of integration a second predetermined time period after the sensing of the engine deceleration than during the time prior to the sensing of the engine deceleration, the output from the integral controller being applied to the air-fuel mixing and proportioning device.

Specifically, the integral controller includes a monostable device which is operable to change from its quiescent state to its active or quasi-stable state in response to the sensed engine acceleration for the first predetermined period, a variable RC time constant circuit for integrating the output from the comparator and operable to change its time constant to a lower value in response to the quasi-stable state of the monostable device, and means for retaining the time constant value of the time constant circuit for the second predetermined period in response to the sensed engine deceleration. The variable RC time constant circuit is further operable to change its time constant to a higher value of integration at the end of the second predetermined period.

The apparatus may further include a proportional controller and a summation circuit operable to provide summation of the outputs from the proportional and integral controllers. The proportional controller is operable to provide linear proportioning of the output from the comparator at a higher value of proportioning during the first predetermined period upon the sensing of the acceleration than during the time prior to the sensing of the acceleration and at a lower value of proportioning the second predetermined period after the sensing of the deceleration than during the time prior to the sensing of the deceleration.

The invention will be further described by way of example in connection with the accompanying drawings, in which.

Figure 1:
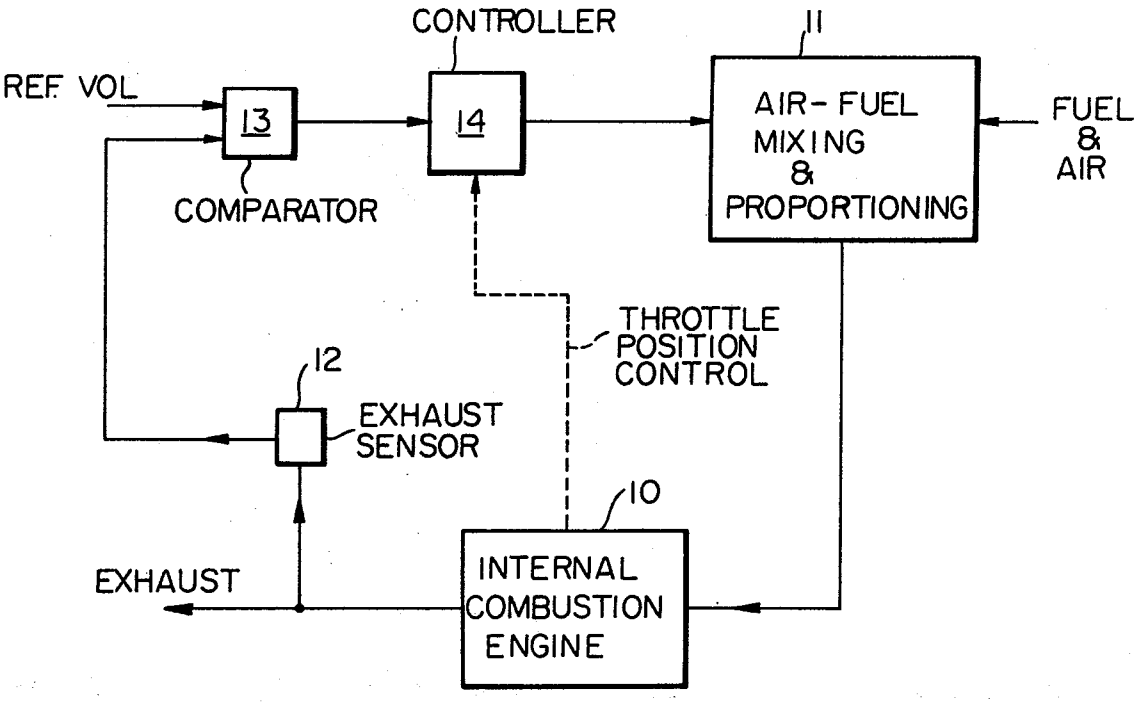
FIG. 1 is a schematic block diagram of an embodiment of the invention.

Referring now to FIG. 1, there is shown a general construction of the air-fuel mixture control apparatus of the invention. A mixture of air and fuel is supplied to an internal combustion engine 10 through an air-fuel mixing and proportioning device 11 which may be a carburetor of the type having an air bleed passage controlled by an electromagnetic valve or a fuel injection unit. In the passage of exhaust gases from the engine 10 is provided an exhaust composition sensor 12 which may, for example, an oxygen sensor providing an electrical signal whose amplitude represents the concentration of oxygen in the exhaust emissions. The oxygen composition representative signal is fed to a comparator 13 for comparison with a reference voltage. The comparator 13 generates a signal at one of two discrete values depending upon whether the exhaust composition signal is above or below the reference voltage and applies it to a controller 14 which modulates the amplitude of the signal in accordance with a predetermined control characteristic. A differential amplifier may be used as the comparator 13. The air-fuel mixing and proportioning device 11 receives the signal from the controller 14 to proportion the air-fuel mixture ratio in response to the level of the received signal in such manner that when the exhaust composition signal is above the reference value the air-fuel mixture is controlled in a direction that reduces the amplitude of the exhaust composition signal.

Because of the inherent delay time from the time of fuel injection to the time of exhaust composition sensing, the control signal tends to keep influencing the proportioning device in the same direction even after the predetermined level has been reached, thus resulting in control oscillation.

The control oscillation is particularly severe when the engine is encountered with an external disturbance such as acceleration or deceleration.

Figure 2:
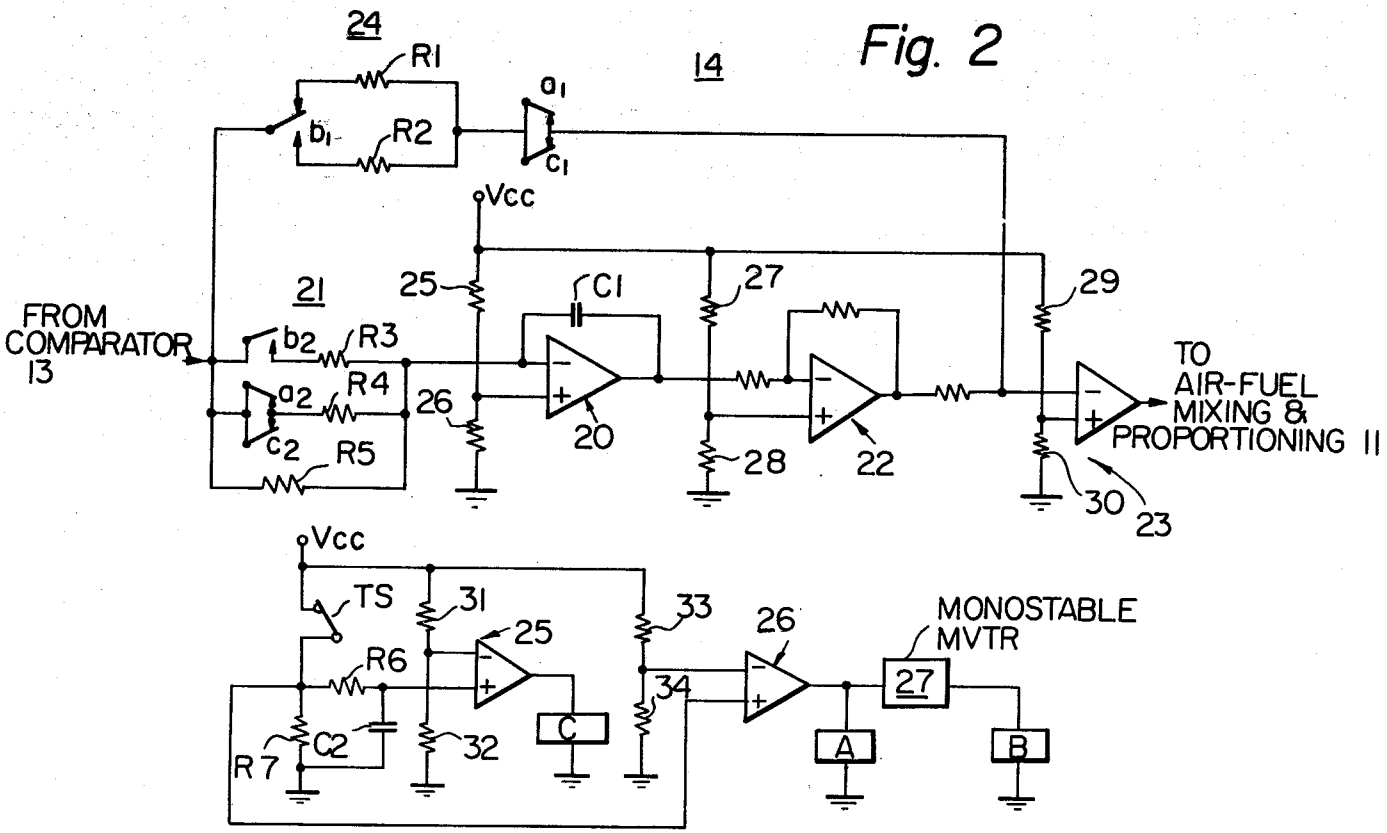
FIG. 2 is a detailed circuit diagram of a controller depicted in the diagram of FIG. 1.

FIG. 2 illustrates details of the controller 14 incorporating the principle of the invention. The controller 14 comprises an integrating control operational amplifier 20 having an integrating capacitor C1 connected across its output and inverting input which is connected through a switched resistor network 21 to the output of comparator 13. The output of operational amplifier 20 is connected to an inverting operational amplifier 22 which serves to reverse the polarity of output from the amplifier 20 before application of the integrated signal to a summation operational amplifier 23. A second switched resistor network 24 is connected across the output of comparator 13 and the inverting input of the summation amplifier 23. The second resistor network 24 serves to operate as a proportional controller. The non-inverting input of each of the operational amplifiers 20, 22 and 23 is connected to a DC voltage Vcc through voltage dividers formed respectively by series-connected resistors 25 and 26 (27, 28 and 29, 30).

A comparator operational amplifier 25 is provided having its inverting input connected to a DC voltage source Vcc through a voltage divider formed by resistors 31 and 32 and its non-inverting input connected to a junction between resistor R6 and capacitor C2 which forms a delay circuit. The delay circuit is connected between the voltage source Vcc through a normally closed throttle position switch TS and ground and shunted by a resistor R7. The output of operational amplifier 25 is connected through a relay C to ground.

An operational amplifier 26 is provided having its non-inverting input connected to the junction between the throttle position switch TS and resistor R7 and its inverting input connected to the voltage source Vcc through a voltage divider formed by resistors 33 and 34. The output of amplifier 26 is connected to ground through a relay A and to the input to a monostable multivibrator 27 of trailing edge triggered type whose output is connected through relay B to ground. The relay A has a pair of normally closed contact units $a_1$ and $a_2$, the relay B having its own transfer contact unit $b_1$ and normally open contact unit $b_2$, and the relay C having a pair of normally closed contact units $c_1$ and $c_2$.

The switched resistor network 21 includes a set of parallel-connected resistor circuits including resistors R3, R4 and R5. The normally open contact $b_2$ is series connected with resistor R3 to form a parallel circuit with resistor R5 when relay B is operated. The normally closed contact unit $a_2$ and $c_2$ are parallel connected to each other and in series circuit with resistor R4 to connect it in parallel with resistor R5 when both relays A and C remain inoperated.

The switched resistor network 24 includes resistors R1 and R2 having one end connected together to the inverting input of the summation operational amplifier 23 through parallel-connected contact units $a_1$ and $c_1$, the resistor R1 being connected at the other end through the normally closed side of the transfer contact unit $b_1$ to the output of comparator 13 and the resistor R2 being connected at the other end through the normally open side of the contact unit $b_1$. The resistor R1 has a greater value of resistance than R2.

Figure 3:
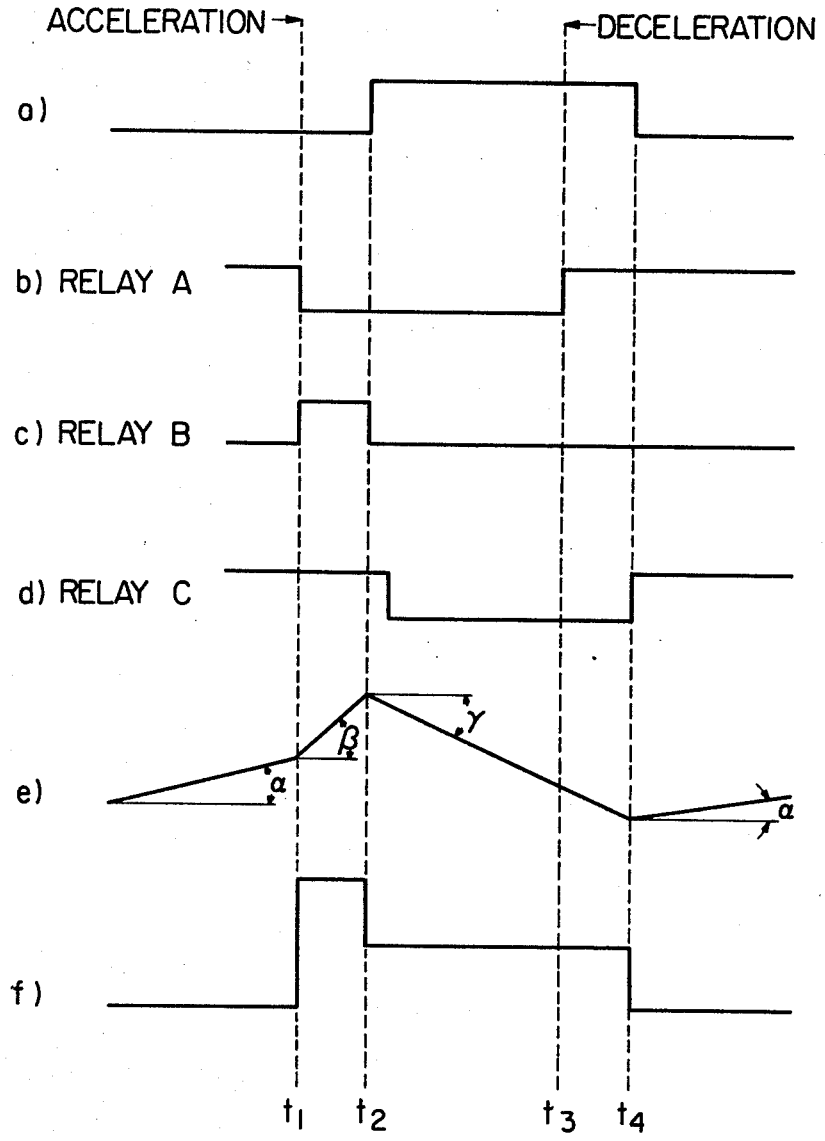
FIG. 3 is a waveform diagram useful for describing the operation of the circuit of FIG. 2.

The operation of the circuit of FIG. 2 will be described in relation to the operating diagram of FIG. 3. During the time period prior to acceleration of a vehicle, the throttle position switch TS remains closed to develop a voltage across resistor R7, the voltage being applied to the non-inverting input of operational amplifier 26 and through resistor R6 to the non-inverting input of amplifier 25 to raise their potentials to a level higher than the potential at their inverting input so that amplifiers 25 and 26 provide currents that energize the relays A and C. The operation of relays A and C cuts off the connection of resistor network or proportional controller 24 to the summation circuit 23 and further disconnects resistor R4 from resistor R5. Therefore, the integrating time constant of the integral controller 20 is R5, C1 which is the smallest value of the integrator so that the integrated output voltage is allowed to rise at the lowest integration rate $\alpha$ as indicated in FIG. 3*e*. Upon acceleration of the vehicle at time $t=t_1$, the throttle position switch TS will be open and the operational amplifiers 25 and 26 will be switched to the low output state which de-energizes the relay A and subsequently relay C after time $t=t_2$ to restore their contacts $a_1$, $a_2$ and $c_1$, $c_2$. At the instant the output of comparator 26 goes low, the monostable multivibrator 27 produces a pulse with a duration from time $t=t_1$ to $t=t_2$. This pulse energizes the relay B (FIG. 3*c*) resulting in parallel connection of resistors R3, R4 and R5 so that the integrating time constant is at its lowest value to allow the integrated voltage to rise at the highest rate $\beta$ during the time interval $t=t_1$ to $t=t_2$ as shown in FIG. 3*e*. Simultaneously, the resistor $R_2$ is placed into the proportional control circuit 24. Since R2 is smaller than R1, the proportioning rate is at the greatest value during the time interval $t=t_1$ to $t=t_2$ as shown in FIG. 3*f*. It will be understood that during the time interval $t=t_1$ to $t=t_2$, the overall control gain is raised to a maximum level. This allows the amount of fuel supply to be sharply increased to compensate for the air-fuel mixture which is leaner than is desired during the transient period after engine acceleration. This prevents the mixture from becoming leaner than is appropriate during the transient period of engine acceleration.

At time $t=t_2$, the relay B is released and as a result resistor $R_4$ is left connected with resistor R5. Assuming that the exhaust composition signal from sensor 12 is above the reference setting value during the time interval from $t=t_2$ to $t=t_4$, and the comparator 13 produce a pulse as indicated in FIG. 3*a*. The integrated output will decrease at an intermediate integration rate $\gamma$ in the opposite direction of integration. On the other hand, the release of relay B places resistor $R_1$ instead of $R_2$ in the proportional control circuit to decrease the proportioning rate.

During the cruising interval from time $t=t_2$ to $t=t_3$, the overall control gain of the controller 14 is set at the intermediate value.

Deceleration of the vehicle at time $t=t_3$ closes the throttle position switch TS charging capacitor C2 through resistor R6. After a predetermined interval at time $t=t_4$, the voltage at the non-inverting input of operational amplifier 25 reaches the voltage at its inverting input.

Deceleration of the vehicle at time $t=t_3$ closes the throttle position switch TS. This operates relay A and at the same time charges capacitor C2 through resistor R6. After a predetermined interval, the voltage at the non-inverting input of operational amplifier 25 reaches the voltage at its inverting input so that relay C will be operated at time $t=t_4$. Therefore, during the time interval $t=t_3$ to $t=t_4$, the overall control gain of the controller 14 remains unchanged. This allows compensation of the rich air-fuel mixture that is present during the time interval $t=t_3$ to $t=t_4$ due to the engine's transport delay time and at time $t=t_4$ onward, both resistors R3 and R4 are disconnected from resistor R5 and the integration rate is changed to the smallest value and the proportioning circuit is cut off, so that the overall control gain is reduced to a minimum level to suppress the ensuring control oscillation.

What is claimed is:

1. A mixture control apparatus for an internal combustion engine having means for sensing an exhaust composition of the emissions from the engine, air-fuel mixing and proportioning device for said engine, and a comparator for generating an output when the sensed composition reaches a predetermined value, the apparatus comprising:

means for sensing acceleration and deceleration of the engine; and an intergral controller operable to provide integration of the output from the comparator at a higher rate of integration for a first predetermined time period after the sensing of the engine acceleration than during the time prior to the sensing of the engine acceleration and at a lower rate of integration for a second predetermined time period after the sensing of the engine deceleration than during the time prior to the sensing of the engine deceleration, the output from the integral controller being applied to the air-fuel mixing and proportioning device; and wherein said integral controller comprises:

a monostable device having active and inactive states and operable to respond to the sensed engine acceleration to assume its active state for a first predetermined interval;

a variable RC time constant circuit for integrating the output from said comparator and operable to change its time constant to a lower value in response to the active state of said monostable device; and means for retaining the time constant value of said RC time constant circuit for a second predetermined interval in response to the sensed engine deceleration;

said variable RC time constant circuit being operable to change its time constant to a higher value in response to the elapse of said second predetermined interval.

2. A mixture control apparatus for an internal combustion engine having means for sensing an exhaust composition of the emissions from the engine, air-fuel mixing and proportioning device for said engine, and a comparator for generating an output when the sensed composition reaches a predetermined value, the apparatus comprising:

means for sensing acceleration and deceleration of the engine; and an integral controller operable to provide integration of the output from the comparator at a higher rate of integration for a first predetermined time period after sensing of the engine acceleration than during the time prior to the sensing of the engine acceleration and at a lower rate of integration for a second predetermined time period after the change sensing of the engine deceleration than during the time prior to the sensing of the engine deceleration, the output from the integral controller being applied to the air-fuel mixing and proportioning device, and wherein said integral controller comprises:

a first relay having first and second states and operable to change from the first to the second state in response to the sensed engine acceleration and change from the second to the first state in response to the sensed engine deceleration;

a monostable device having active and inactive states and responsive to the sensed engine acceleration to assume its active state for a predetermined duration;

a second relay having first and second states and operable to change from the second to the first state in response to the active state of the monostable device and remain in the first state for the predetermined duration;

a delay circuit responsive to the sensed engine deceleration;

a third relay having first and second states and operable to change from the first to the second state in response to the sensed engine acceleration and change from the second to the first state in response to the delay circuit; and a variable RC time constant circuit having low, high and intermediate values of time constant and operable to change its time constant to the low value when the second relay is in its first state, and to the high value when the first and third relays are simultaneously in their first states, and to the intermediate value when the second and third relays are simultaneously in their second state.

3. A mixture control apparatus for an internal combustion engine having means for sensing an exhaust composition of the emissions from the engine, air-fuel mixing and proportioning device for said engine, and a comparator for generating an output when the sensed composition reaches a predetermined value, the apparatus comprising:

means for sensing acceleration and deceleration of the engine; and an integral controller operable to provide integration of the output from the comparator at a higher rate of integration for a first predetermined time period after the sensing of the engine acceleration than during the time prior to the sensing of the engine acceleration and at a lower rate of integration for a second predetermined time period after the sensing of the engine deceleration than during the time prior to the sensing of the engine deceleration, the output from the integral controller being applied to the air-fuel mixing and proportioning device; and further comprising a proportional controller and a summation circuit operable to provide summation of the outputs from the proportional and integral controllers, and wherein the proportional controller is operable to provide linear proportioning of the output from the comparator at a higher value of proportioning during said first predetermined time period upon the sensing of the engine acceleration than during the time prior to the sensing of the engine acceleration and at a lower value of proportioning during said second predetermined time period after the sensing of the engine deceleration than during the time prior to the sensing of the engine deceleration.

4. A mixture control apparatus as claimed in claim 3, wherein said integral controller comprises:

a monostable device having active and inactive states and operable to respond to the sensed engine acceleration to assume its active state for a first predetermined interval;

a variable RC time constant circuit for integrating the output from said comparator and operable to change its time constant to a lower value in response to the active state of said monostable device; and means for retaining the time constant value of said RC time constant circuit for a second predetermined interval in response to the sensed engine deceleration;

said variable RC time constant circuit being operable to change its time constant to a higher value in response to the elapse of said predetermined interval.

5. A mixture control apparatus as claimed in claim 3, wherein said proportional controller comprises:

a first relay having first and second states and operable to change from the first to the second state in response to the sensed engine acceleration and change from the second to the first state in response to the sensed engine deceleration;

a monostable device having active and inactive states and responsive to the sensed engine acceleration to assume its active state for a predetermined duration;

a second relay having first and second states and operable to change from the second to the first state in response to the active state of the monostable device and remain in the first state for said predetermined duration;

a delay circuit responsive to the sensed engine deceleration;

a third relay having first and second states and operable to change from the first to the second state in response to the sensed engine acceleration and change from the second to the first state in response to the delay circuit; and a variable resistance network having low, high and intermediate values of resistance between the output of said comparator and the input to said summation circuit and operable to change its resistance to the low value when the second relay is in its first state, and to the high value when the first and third relays are simultaneously in their first states, and to the intermediate value when the second and third relays are simultaneously in their second states.

6. A mixture control apparatus for an internal combustion engine having means for sensing an exhaust composition of the emissions from the engine, air-fuel mixing and proportioning device for said engine, and a comparator for generating an output when the sensed composition reaches a predetermined value, the apparatus comprising:

means for sensing acceleration and deceleration of the engine; and an integral controller operable to provide integration of the output from the comparator at a highest rate of integration for a first predetermined interval in response to the sensed engine accelerating and at a lowest rate of integration for a second predetermined interval after the sensing of the engine deceleration, and further operable to provide integration at a rate of intermediate value between the highest and lowest rates of intergration when the engine is operated for cruising drive, the output from the integral controller being applied to the air-fuel mixing and proportioning device; and further comprising a proportional controller and a summation circuit operable to provide summation of the outputs from the proportional and integral controllers, and wherein the proportional controller is operable to provide linear proportioning of the output from the comparator at a highest value of proportioning during said first predetermined interval upon the sensing of the engine acceleration and at a lowest value of proportioning during said second predetermined interval after sensing of the engine deceleration and at an intermediate value between said lowest and highest values of proportioning when the engine is operated for cruising drive.

7. A closed loop mixture control apparatus for an internal combustion engine having an exhaust gas sensor for sensing the concentration of an exhaust composition of the emissions from the engine, air-fuel mixing and proportioning device for supplying air and fuel to said engine in a variable ratio in response to a control signal, and a comparator for detecting when the sensed concentration reaches a predetermined value representing a desired air-fuel ratio for generating a signal representing the deviation of air-fuel ratio from the desired air-fuel ratio, the apparatus comprising:

first means for generating a first signal in response to acceleration of the engine and a second signal in response to deceleration of the engine;

an integral controller for providing integration of the output from said comparator at a variable integration rate;

second means responsive to said first signal to increase the rate of said integration for a first predetermined time period to compensate for an insufficient supply of fuel during the transient period and decrease said integration rate in response to the elapse of said first predetermined time period to a value higher than the integration rate provided during the time prior to the generation of said first signal;

third means operable to decrease the rate of said integration to a value lower than the rate provided during the time prior to the generation of said second signal; and fourth means for delaying the operation of said integration rate decreasing means for a second predetermined time period in response to said second signal to retain the previous integration rate during said second predetermined period to suppress the tendency of the closed loop control to oscillate about said desired air-fuel ratio.

8. A mixture control apparatus as claimed in claim 7, wherein said second, third and fourth means comprise:

a first relay operable to change from a first to a second circuit condition in response to said first signal and operable to change from the second to the first circuit condition in response to said second signal;

a monostable device responsive to said first signal to generate an electrical pulse of said first predetermined time period;

a second relay operable to change from a first to a second circuit condition in response to said electrical pulse and remain in said second circuit condition in the presence of said electrical pulse;

a RC delay circuit responsive to said second signal to provide an output at a delayed interval corresponding to said second predetermined time period; and a third relay operable to change from a first to a second circuit condition in response to said first signal and operable to change from the second to the first circuit conditions in response to the output from said RC delay circuit;

said integral controller having low, medium and high values of integration rate and operable to assume the high value in response to said second circuit condition of said second relay, operable to assume said low value in response the simultaneous presence of said first circuit conditions of said first and third relays, and operable to assume said medium value in response to the simultaneous presence of said second circuit conditions of said second and third relays.

9. A closed loop mixture control apparatus for an internal combustion engine having an exhaust gas sensor for sensing the concentration of an exhaust composition of the emissions from the engine, air-fuel mixing and proportioning device for supplying air and fuel to said engine in a variable ratio, and a comparator for detecting when the sensed concentration reaches a predetermined value representing a desired air-fuel ratio for generating a signal representing the deviation of air-fuel ratio from said desired air-fuel ratio, the apparatus comprising:

means for generating a first signal in response to the acceleration of said engine and a second signal in response to the deceleration of said engine;

an integral controller operable to provide integration of the output from the comparator at a variable integration rate;

means for causing said controller to integrate at a high rate of integration in response to said first signal for a first predetermined interval to compensate for an insufficient supply of fuel during the transient period;

means operable to cause said controller to integrate at a low rate of integration;

means for delaying the operation of said low-rate integration causing means for a second predetermined interval in response to the second signal to retain the previous integration rate during said second predetermined interval to suppress the tendency of the closed loop control to oscillate about said desired air-fuel ratio; and means for causing said integral controller to integrate at a rate intermediate between said high and low integration rates during the time between acceleration and deceleration, the output from the integral controller being said control signal.

10. A closed-loop mixture control apparatus for an internal combustion engine having an exhaust gas sensor for sensing the concentration of an exhaust composition of the emissions from the engine, air-fuel mixing and proportioning device for supplying air and fuel to said engine in a variable ratio in response to a control signal, and a comparator for detecting when the sensed concentration reaches a predetermined value representing a desired air-fuel ratio for generating a signal representative of the deviation of air-fuel ratio from the desired air-fuel ratio, the apparatus comprising:

means for generating an electrical signal in response to the acceleration of said engine;

an integral controller for providing integration of the output from said comparator at a variable integration rate; and means responsive to said signal to increase the rate of said integration for a predetermined time period to compensate for an insufficient supply of fuel during the transient period.

11. A closed-loop mixture control apparatus for an internal combustion engine having an exhaust gas sensor for sensing the concentration of an exhaust composition of the emissions from the engine, air-fuel mixing and proportioning device for supplying air and fuel to said engine in a variable ratio in response to a control signal, and a comparator for detecting when the sensed concentration reaches a predetermined value representing a desired air-fuel ratio for generating a signal representative of the deviation of air-fuel ratio from the desired air-fuel ratio, the apparatus comprising:

means for generating an electrical signal in response to the deceleration of said engine;

an integral controller for providing integration of the output from said comparator at a variable integration rate;

means operable to decrease the rate of said integration; and means for delaying the operation of said integration rate decreasing means for a predetermined period of time in response to said electrical signal to retain the previous integration rate during said predetermined period to suppress the tendency of the closed loop control to oscillate about said desired air-fuel ratio.

12. A mixture control apparatus as claimed in claim 12, further comprising a proportional controller and a summation circuit operable to provide summation of the outputs from the proportional and integral controllers, and wherein the proportional controller is operable to provide linear proportioning of the output from the comparator at a higher value of proportionality during said first predetermined time period in response to said first signal than during the time prior to the generation of said first signal and at a lower value of proportionality said second predetermined time period after the generation of said second signal than during the time prior to the generation of said second signal.

13. A mixture control apparatus as claimed in claim 9, further comprising a proportional controller and a summation circuit operable to provide summation of the outputs from the proportional and integral controllers, and wherein the proportional controller is operable to provide linear proportioning of the output from the comparator at a highest value of proportionality during said first predetermined interval in response to said first signal and at a lowest value of proportionality said second predetermined interval after the generation of said second signal and at an intermediate value between said lowest and highest values of proportionality when the engine is operated for cruising drive.

* * * * *